US005274202A

United States Patent [19]

Kezer et al.

[11] Patent Number: 5,274,202

[45] Date of Patent: Dec. 28, 1993

[54] ELEVATOR DISPATCHING ACCOMMODATING INTERFLOOR TRAFFIC AND EMPLOYING A VARIABLE NUMBER OF ELEVATOR CARS IN UP-PEAK

[75] Inventors: Jeremy B. Kezer; James M. Collins, both of Farmington, Conn.

[73] Assignee: Otis Elevator Company, Farmington, Conn.

[21] Appl. No.: 927,044

[22] Filed: Aug. 10, 1992

[51] Int. Cl.[5] ..... B66B 1/20

[52] U.S. Cl. ..... 187/125; 187/132; 187/131

[58] Field of Search ..... 187/124, 125, 130, 131, 187/132, 138

[56] References Cited

U.S. PATENT DOCUMENTS 3,743,057 7/1973 Hall et al. ..... 187/124
4,305,479 12/1981 Bittar et al. ..... 187/125
4,875,554 10/1989 MacDonald et al. ..... 187/124

*Primary Examiner*—Steven L. Stephan
*Assistant Examiner*—Robert Nappi

[57] ABSTRACT

Factors (IFL, UPK, DPK) indicative of the relative need for an elevator system to be operating in off-peak, up-peak and down-peak modes, respectively, are compared and if the relative need for up-peak is greater than for off-peak or down-peak, the ratio of up-peak need to total need is utilized to assign a proportionate number of elevator cars to up-peak service. Cars are chosen for up-peak service based upon the estimated relative speed with which the cars will be able to return to the lobby. The details of one embodiment include determining interfloor traffic by examining expected destinations of passengers estimated to be waiting behind hall calls and examining the lobby and non-lobby car calls which are registered.

4 Claims, 7 Drawing Sheets

(Fig. 6B)

ELEVATOR DISPATCHING ACCOMMODATING INTERFLOOR TRAFFIC AND EMPLOYING A VARIABLE NUMBER OF ELEVATOR CARS IN UP-PEAK

TECHNICAL FIELD

This invention relates to elevator dispatching in which interfloor traffic is used in determining onset/termination of peak modes and a variable number of elevator cars may be employed to provide up-peak service in an elevator system.

BACKGROUND ART

In order to limit the number of elevators which are required to adequately service a building, elevator dispatching systems are designed to accommodate varying traffic patterns that exist in buildings. It has long been known to provide up-peak dispatching in the early hours of the business day, down-peak dispatching at the close of the business day, and off-peak dispatching during the remainder of the day. Up-peak dispatching takes into account the fact that many passengers will arrive at the lobby and simply desire to be transported to the floor of their work assignment. Similarly, down-peak dispatching takes into account the fact that many passengers simply want to be returned to the lobby on their way home. A variety of schemes are known for predicting the onset and termination of the need to provide up-peak service. Examples include U.S. Pat. Nos. 4,804,069, 4,838,384; and 5,035,302. In a commonly owned co-pending U.S. patent application of Kameli entitled "Prediction Correction for Elevator Traffic Shifts During Peak Conditions", Ser. No. 507/580,905 filed on Sep. 11, 1990, the peak period is adjusted in dependence on actual current conditions. An additional commonly owned co-pending U.S. patent application of Thangavelu entitled ""Artificial Intelligence" Based Learning System Predicting "Peak Period" Times for Elevator Dispatching", Ser. No. 07/644,356 filed on Jan. 22, 1991, utilizes historical data to improve determining the proper onset and termination of peak periods. A more recent innovation utilizes fuzzy logic to determine the onset and termination of peak periods, as set forth in a commonly owned co-pending U.S. patent application of Sirag et al entitled "Using Fuzzy Logic to Determine the Traffic Mode of an Elevator System", Ser. No. 07/879,558 filed on May 4, 1992. That system in turn utilizes the concepts set forth in another commonly owned co-pending U.S. patent application of Sirag entitled "Using Fuzzy Logic to Determine the Number of Passengers in an Elevator Car", Ser. No. 07/879,528 filed on May 4, 1992. In another commonly owned copending U.S. patent application of Sirag entitled "Estimating Number of People Waiting for an Elevator Car Based on Crisp and Fuzzy Values", Ser. No. 07/879,531 filed on May 4, 1992, there is disclosed a method of estimating the number of people behind an up hall call or a down hall call at a specific floor.

There are a variety of techniques which are utilized to assign hall calls to be answered by selected cars, some of which are disclosed in U.S. Pat. Nos. 4,363,381; 4,815,568; and 5,024,295. All of the aforementioned patents and applications are incorporated herein by reference.

It should be understood that the determination of when peak periods should begin and end is relatively independent of the manner in which an up-peak or down-peak mode of elevator traffic dispatching is carried out. That is, determining when to do it is relatively independent of determining how to do it. Typically, in prior elevator dispatching systems, if it is determined that the elevator dispatching mode should be an up-peak mode of dispatching, the system is usually shifted totally into the up-peak mode, reserving only one or two elevator cars (on a static basis) to service non up-peak traffic during the up-peak period.

DISCLOSURE OF INVENTION

Objects of the invention include provision of improved determination of peak mode elevator dispatching, and improved up-peak dispatching.

This invention is predicated on the observation that prior peak mode dispatching systems are deficient possibly because they are either totally in a peak mode or not in a peak mode. It is postulated herein that the need to continuously improve and seek to perfect the methodology by which it is determined when the system should be thrown into a peak mode or removed from it is all due to the fact that it is an all-or-nothing choice, and the choice is based only on lobby traffic.

According to the present invention, the need for up-peak, down-peak and interfloor elevator services are compared, and the elevator system is declared to be in the mode having the greatest need in accordance with the relative demand for each. According further to the invention, the number of elevator cars which are assigned to operate in an up-peak mode of dispatching is proportional to the relative need for up-peak service. If up-peak demand exceeds demand for down-peak or interfloor traffic, then a number of elevator cars are assigned to up-peak mode of elevator dispatching, the number being dependent upon the ratio of need for up-peak service to the ratio of the total need for up-peak, down-peak and interfloor (off-peak) service. The invention may be practiced by utilizing fuzzy sets indicative of the relative need for up-peak and down-peak service and the need for interfloor service. The invention may also be practiced using crisp values indicative of the need to provide service in various modes.

The present invention can be implemented in a wide variety of computer systems, it being irrelevant as to the nature of the system and the manner in which it provides up-peak service, down-peak service or interfloor service, other than that there be the ability to compare the relative needs and to assign a relative number of elevator cars to up-peak, when appropriate, all as described hereinafter.

Other objects, features and advantages of the present invention will become more apparent in the light of the following detailed description of exemplary embodiments thereof, as illustrated in the accompanying drawing.

BRIEF DESCRIPTION OF THE DRAWINGS

FIG. 3—up traffic evaluation in an elevator car;

FIG. 4—hall traffic evaluation;

FIG. 5—up-peak ratio determination;

FIG. 7—selecting up-peak cars.

BEST MODE FOR CARRYING OUT THE INVENTION

Figure 1:
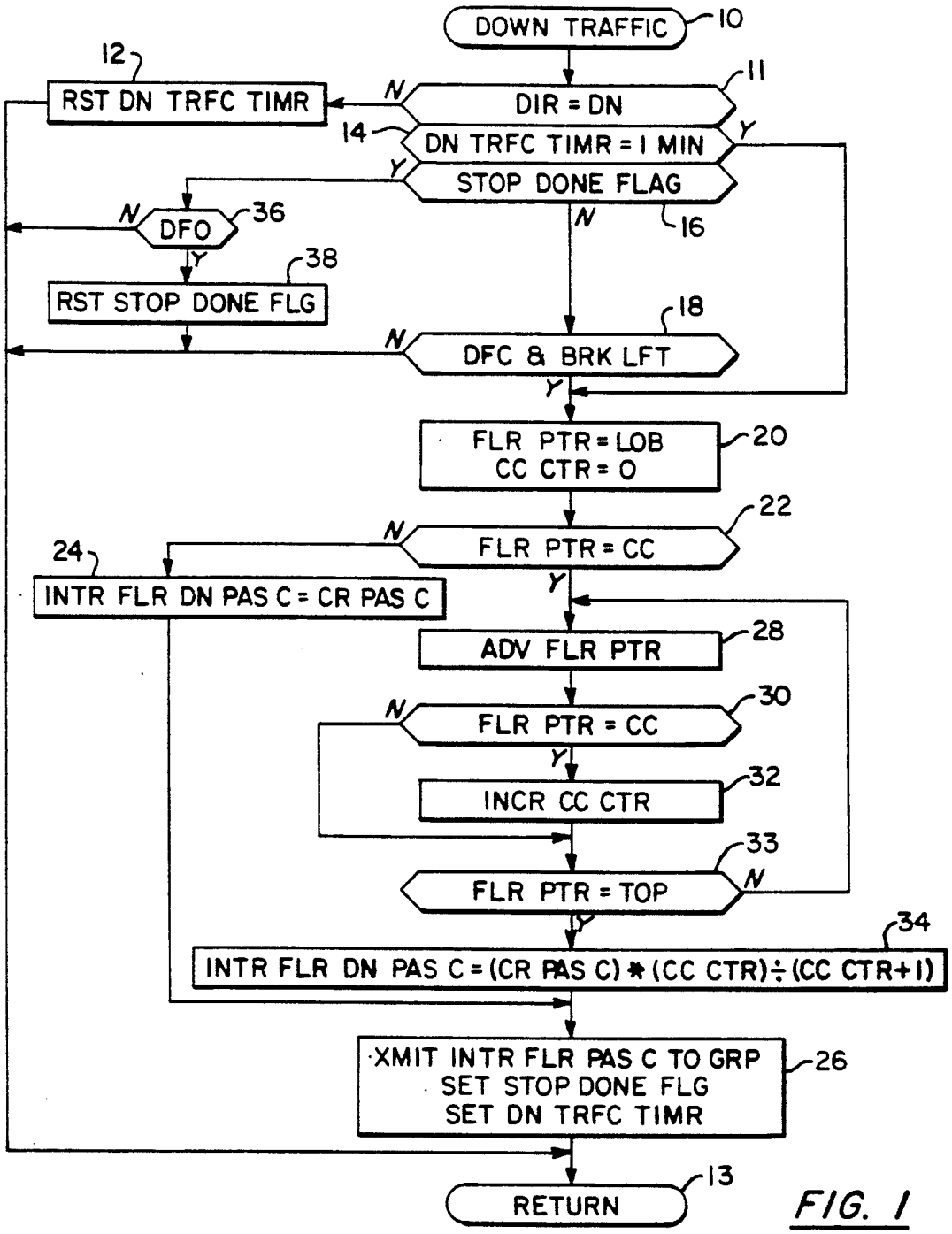
FIG. 1 is a logic flow diagram of a routine for performing down traffic evaluation in an elevator car.

The implementation of the present invention involves a determination of whether the system should be operated with dispatching in an up-peak mode, a down-peak mode, or an off-peak mode (which is neither up-peak nor down-peak). In the present embodiment, it is assumed that the down-peak mode of dispatching is the same as the off-peak mode of dispatching except for the fact that any idle car (a car without a registered car call or an assigned hall call) will be dispatched to an upper floor to be parked and thereby be ready, when necessary, to carry downward traffic. The parking of idle down-peak cars is applicable to any idle car, and therefore there is no assignment of cars to the down-peak mode of dispatching. The present embodiment assumes an up-peak mode of traffic which includes removing any car assigned to up-peak traffic service from the group controller's ability to assign hall calls to such car. And, any car assigned to up-peak service will immediately return directly to the lobby, without answering any down hall calls, as soon as its up calls have all been handled. If one assumes that any call behind the car is not registered as a car call, the up-peak car will respond only to car calls registered by lobby passengers, and by passengers who enter the car at floors where lobby passengers get off. Of course, the scheme of utilization of cars assigned to up-peak can vary from the scheme described: for instance, the group controller may be allowed to assign up calls to cars which are to make a car call stop at the up call floor, etc.

The embodiment of the invention herein determines which of the three modes (up-peak, down-peak or off-peak) should control dispatching. If dispatching is to be in accordance with the down-peak or off-peak mode, the entire, available system operates in the down-peak or off-peak mode, and there is no need to determine which of the cars available to the group will be operating in such mode. However, in accordance with the invention, the dispatching system can operate in the up-peak mode either a little bit (with only one car assigned to up-peak traffic) or more (with two or three cars assigned to up-peak traffic) or heavily (with nearly all or all of the cars assigned to up-peak traffic). This is a principal characteristic of the present invention: the degree of dispatching of elevators in accordance with an up-peak mode is adjusted by the number of cars which are assigned for service in that mode, which in turn is determined by the degree to which up-peak traffic requirements exceed down-peak traffic and/or interfloor traffic requirements. Thus, in one embodiment, if up-peak traffic demand is determined to be barely greater than either down-peak traffic demand or interfloor traffic demand, only about one-third of the elevators will be assigned to operate in the up-peak mode of dispatching. On the other hand, if the up-peak traffic demand is determined to be twice as great as the down-peak traffic demand and interfloor traffic demand combined, then about two-thirds of the elevators available to the group may be assigned to operate in the up-peak mode of dispatching. This relative degree of operation in an up-peak mode, by assigning a corresponding relative number of cars for service in the up-peak mode of dispatching, is achieved by assigning cars to the up-peak mode of dispatching in the same ratio as the up-peak mode of traffic bears to the total traffic.

In order to determine the ratio which the up-peak traffic requirement bears to the total traffic requirement, a relative determination of the up-peak traffic demand is calculated, a relative determination of the down-peak traffic demand is calculated, and a relative determination of the interfloor traffic is separately calculated. As described hereinafter, this may be achieved in a variety of ways: however, the preferred embodiment of the present invention determines the relative up-peak traffic demand and the relative down-peak traffic demand in accordance with the teachings of the aforementioned patent application entitled "Using Fuzzy Logic to Determine the Traffic Mode of an Elevator System", utilizing passenger information provided thereto in accordance with the teachings of the aforementioned patent application entitled "Using Fuzzy Logic to Determine the Number of Passengers in an Elevator Car", (the teachings of which are also disclosed in the aforementioned application entitled "Using Fuzzy Logic to Determine the Traffic Mode of an Elevator System"). In this way, a fuzzy set indicative of passenger information as the passenger leaves the lobby is utilized to determine a plurality of fuzzy sets indicative of the likelihood that up-peak traffic is occurring (and requires service) the least memberships of which together form a fuzzy set indicative of that likelihood, the greatest membership of which in turn is a value indicative of the degree to which up-peak traffic is determined to require service. In a similar way, a number is obtained indicative of the degree to which down-peak traffic requires service. The same passenger information (in a fuzzy set) is utilized to estimate up hall call interfloor traffic, down hall call interfloor traffic, up car call interfloor traffic and down car call interfloor traffic, in the entire system available to the group, to obtain a fuzzy set indicative of interfloor traffic. This is intersected with a predetermined fuzzy set indicative (according to elevatoring knowledge) of what "many interfloor passengers" equal, having basis elements around zero for one or two passengers and increasing to basis elements of one which remain constant for some number of passengers or greater (which may be on the order of 30 passengers in a four elevator group, for instance). The result of the intersection of these two fuzzy sets yields a fuzzy set indicative of the degree to which there are many interfloor passengers in the system at any given time. The selection of the largest membership in this intersection fuzzy set is then compared with the indications of up-peak and down-peak described hereinbefore, to determine which traffic mode of dispatching should be operative (up-peak, down-peak or off-peak), and if the indicated mode is up-peak, the degree to which the system should be in up-peak (the number of available cars which should be assigned to up-peak service).

In the disclosed embodiment, the determination of up car call interfloor traffic and down car call interfloor traffic is determined in each of the respective elevators, in routines which are run each time that the elevator starts a down run or an up run respectively, and the results are transmitted to the group controller as soon as the results have been determined. These counts of interfloor car passenger traffic in the up and down direction are therefore generated and provided to the group in a fashion which is wholly asynchronous with respect to the operation of the group controller, as is described hereinafter. On the other hand, the up hall call and down hall call interfloor traffic for the entire group is determined within the group controller, and is combined with the individual elevator up car call and down car call interfloor traffic information which has been transmitted thereto. A principal aspect of this invention is that the group controller utilizes the summation of this interfloor traffic information to determine an indication of the relative degree to which the system should be operating in an off-peak mode, handling large amounts of interfloor traffic and only small amounts of down-peak or up-peak traffic.

Referring now to FIG. 1, a down traffic routine for determining the interfloor traffic in an elevator as it travels downwardly is reached through an entry point 10 and a first test 11 determines if the direction of the elevator is down. If not, a down traffic timer (described more fully hereinafter) is reset, and the routine reverts to other parts of the elevator controller program through a return point 13. This process will be repeated on some cyclic basis (such as on the order of every second) until such time as the elevator commences a down run and the direction of the elevator is set to down. In such case, the first test 11 will be affirmative reaching a test 14 to determine if it has been a full minute since a down traffic timer was set; the down traffic timer will cause the program to be operated during a down run at least once each minute, even if the elevator gets stuck at a stop (such as by having its doors blocked open or the off switch operated). Assuming that the down traffic timer has not timed out, the negative result of test 14 will reach a test 16 to determine if the elevator has had its car calls checked since leaving the last stop, as indicated by a stop done flag. Initially, a negative result of test 16 will reach a test 18 to see if the elevator is leaving (or has left) a stop. If it has, the doors will be fully closed and motion will have occurred, which may be indicated by the brake lift signal. The routine is thus run when the elevator is traveling in the down direction each time that the elevator leaves a landing (as determined by the test 18) but at all events, at least once each minute (as determined by the test 14). A set of steps 20 will set a floor pointer to point to the lobby floor and reset a car call counter to zero. Then, a test 22 determines if there is a car call for the floor indicated by the floor pointer. If not, this means that there is no car call registered to the lobby and therefore that all of the passengers now in the car are traveling to floors other than the lobby and therefore constitute interfloor traffic. In such case, a negative result of test 22 reaches a step 24 where a fuzzy set indicative of interfloor down passengers for car C is set equal to the fuzzy set of car passengers for car C. The fuzzy set of car passengers is provided by the group controller as described with respect to FIGS. 3–5 in the aforementioned application entitled "Using Fuzzy Logic to Determine the Number of Passengers in an Elevator Car". The group controller uses elevator car weight, which each car transmits to the group controller each time the car leaves a landing, to develop the passengers fuzzy set for each car. In a set of steps 26, this fuzzy set is transmitted to the group controller to represent the interfloor down passengers for car C, and the down traffic timer (utilized in test 14) is set so as to start a new one minute time period. And then, other parts of the elevator controller program are reverted to through the return point 13.

In test 22, should a lobby call have been registered, an affirmative result will reach a step 28 which advances the floor pointer so it will now point to the floor above the lobby floor. A test 30 determines if a car call is registered for that floor, and if it is, an affirmative result will reach a step 32 where the car call counter is incremented. The car call counter keeps track of car calls registered to floors other than the lobby. If there were no car calls registered for the floor above the lobby, the first pass through the test 30 would be negative, bypassing the step 32 so that the car call counter would remain set at zero. Then, a test 33 determines if the floor pointer has been advanced to the top floor, which will indicate when the counting of car calls is complete. In the first pass, a negative result of test 33 will cause the routine to revert to the step 28 where the floor pointer is advanced to the next floor in turn. In like fashion, all of the floors are tested to determine whether or not they have a car call, and all the car calls are registered in the car call counter. When all the floors have been done, an affirmative result of test 33 will reach a step 34 where the fuzzy set of interfloor down passengers for car C is set equal to the fuzzy set of car passengers for car C with, however, each of the memberships reduced by the ratio of the non-lobby calls established by the car call counter to the total number of calls (which is one more than that, indicative of a lobby call indicated by the affirmative result of test 22). This causes the fuzzy set to have memberships indicative of an estimated number of down passengers involved with interfloor traffic, rather than through-lobby (down-peak) traffic. As an example, if the fuzzy set had memberships indicating likelihoods of passengers on the order of 6, 8 and 4, and there were only two calls registered, one of which was to the lobby, then the fuzzy set would have memberships indicating 3, 4 and 2 following step 34. As before, once the interfloor down passenger fuzzy set for car C has been established, the steps 26 will transmit that fuzzy set to the group, set the stop done flag to indicate that the count of car calls has been made after leaving the last stop, and set the down traffic timer, after which other parts of the program are reverted to through the return point 13.

In a next pass through the down traffic routine of FIG. 1, affirmative results of tests 11 and 14 will reach test 16, which will now be positive since the stop done flag was set in the previous pass at the steps 26. Therefore, the car call counting will not be repeated. Instead, an affirmative result of test 16 reaches a test 36 where it is determined if the door is fully open (indicating that the car is at another stop). If so, an affirmative result of test 36 reaches a step 38 in which the stop done flag is reset, so that car call counting can again be accomplished as soon as the car leaves its current stop. In all passes through the down traffic routine of FIG. 1 between stops, after the car call counting has been accomplished, a negative result of test 36 will cause other programming to be reached through the return point 13.

Figure 3:
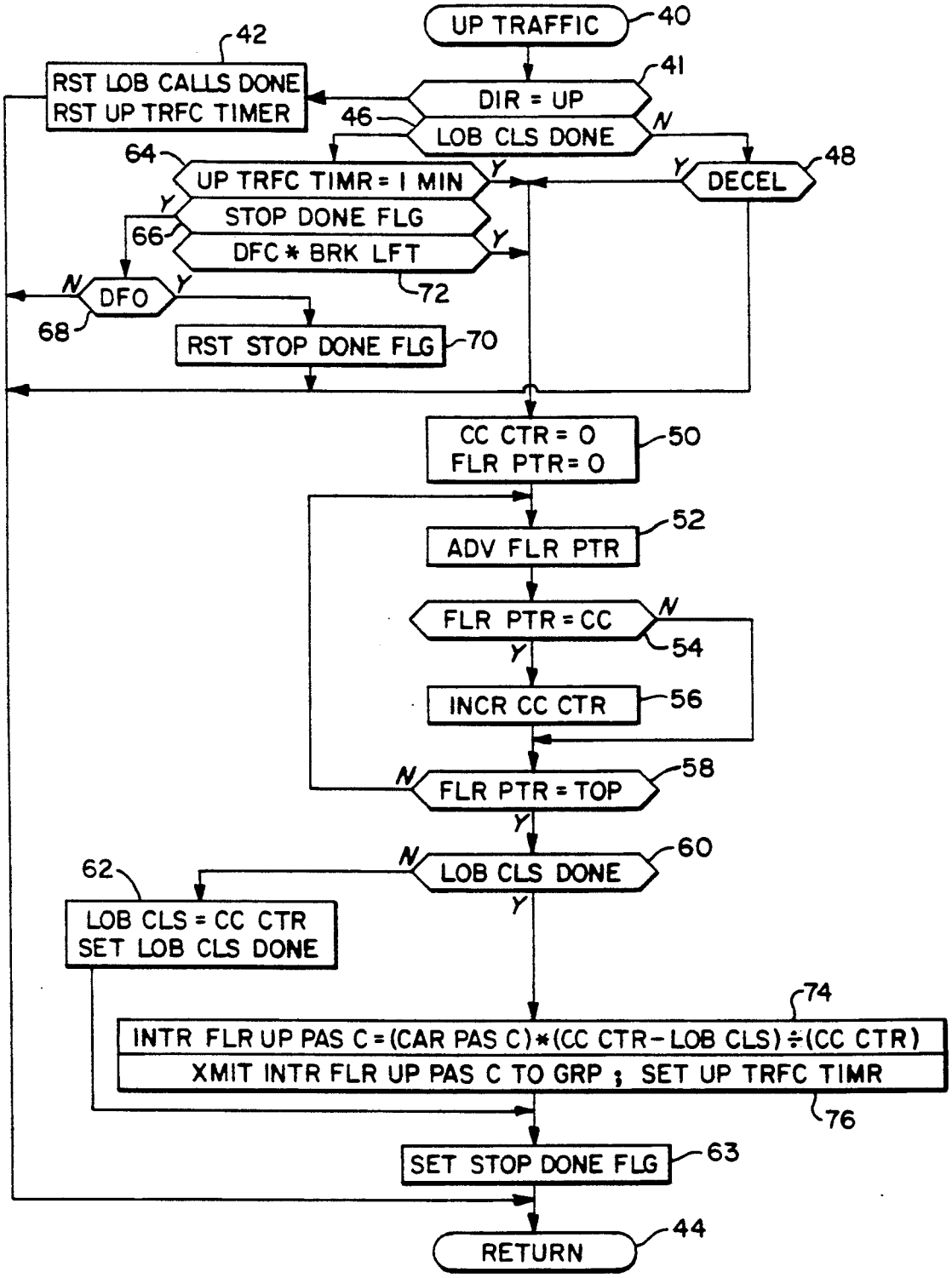
FIGS. 3–7 are logic flow diagrams illustrating routines for performing.

The up traffic routine of FIG. 3 operates in a similar fashion except it must take into account all of the car calls which are initially registered by passengers which enter the elevator on the lobby floor, since none of these represent interfloor traffic. The number of car calls which are registered by passengers entering at the lobby floor must be subtracted from the total number of car calls registered, to determine the estimate of passengers involved in interfloor traffic. The up traffic routine of FIG. 3 is reached through an entry point 40 and a first step 41 determines if the elevator is traveling in the up direction. If it is not, a pair of steps 42 will reset a local programming flag indicative of the lobby calls being done (as described hereinafter), and reset an up traffic timer (which operates in exactly the same fashion as the down traffic timer described hereinbefore). And then other portions of the elevator controller programming are reached through a return point 44. Assuming that the elevator is traveling in the up direction, an affirmative result of the test 41 will reach a test 46 which determines whether the aforementioned lobby calls done flag has been set or not. In the first pass through the routine, it will not have been set and a negative result of test 46 will reach a test 48 to determine if the elevator has started deceleration or not. The test 48 is indicative of the first stop above the lobby and therefore of a point in the run of the elevator where the number of car calls which were registered by lobby passengers can be recognized. If the elevator has not started to decelerate at its first stop, a negative result of the test 48 will cause other parts of the elevator controller program to be reverted to through the return point 44. As the elevator travels toward its first stop, successive passes through the routine of FIG. 3 will find an affirmative result of test 41, a negative result of test 46 and a negative result of test 48. As soon as the elevator begins to slow for its first stop above the lobby, an affirmative result of test 48 will reach a pair of steps 50 wherein the car call counter is set equal to zero and the floor pointer is set equal to the lobby floor. The floor pointer is advanced in a step 52 and a test 54 determines if there is a car call registered for the first floor above the lobby. If so, the car call counter is incremented in a step 56, and a test 58 determines if car calls have been examined for all the floors in the building. Initially, they will not all have been done, so a negative result of test 58 will revert the routine to the step 52 where the floor pointer is advanced to the next floor in turn. Then, the test 54 determines if there is a car call at the next floor and if so, registers it in the car call counter in step 56. If not, step 56 is bypassed. Then, test 58 again determines whether all the floors have been checked or not. Eventually, they will have been, and an affirmative result of test 58 reaches a test 60 where the lobby call done flag is tested. Initially, this flag is not set since it is always reset when the direction is other than up. In the first pass through the routine of FIG. 3, the test 60 will be negative reaching a pair of steps 62 in which a register indicative of the number of car calls which were entered by passengers entering at the lobby floor is set equal to the number of calls presently indicated by the car call counter. And, the lobby calls done flag is then set, so that it is now known that the number of calls entered by lobby passengers has been established. And then other parts of the elevator controller program are reverted to through the return point 44. In the next pass through the routine of FIG. 3, affirmative results of tests 41 and 46 will reach a test 64 to determine if the up traffic timer has reached one minute. In the general case, it will not, and a negative result of test 64 will reach a test 66 to see if the stop done flag has been set, indicating that the up car calls have been counted since leaving the last stop. In the first pass through the test 66 after doing the lobby calls, the result of test 66 will be affirmative since the stop done flag was set in step 63 (indicating that calls have been counted for the lobby stop). Therefore, an affirmative result of test 66 will reach a test 68 to determine if the car has reached the next stop, as indicated by the doors being fully open. At first, each pass through the step 68 will be negative, causing return to other parts of the group controller program through the return point 44. Once the car reaches the first stop, and the doors are fully open, a pass through the up traffic routine of FIG. 3 will reach an affirmative result of the test 68 so that a step 70 will reset the stop done flag, and other programming is reached through the return point 44. Then, subsequent passes through the up traffic routine of FIG. 3 will cause affirmative results of steps 41 and 46, and a negative result of step 64 and 66 to reach a test 72 to determine if the car has begun moving away from the stop. Initially, the result of test 72 will be negative (as the car sits at the stop) and other programming is reached through the return point 44. As soon as the car begins to leave the stop, however, a next pass through the up traffic routine of FIG. 3 will find an affirmative result of test 72 which will reach the steps 50 to commence up call counting as described hereinbefore. Thus the up calls for each floor are examined, and if the floor has a car call the car call counter will be incremented in step 56. When all of the floors have had the car calls examined, an affirmative result of test 58 will reach the test 60, which this time will be affirmative since the lobby calls done flag has previously been set in the step 62. An affirmative result of test 60 reaches a test 74 where a fuzzy set representing interfloor up passengers for car C is created by reducing the memberships of the fuzzy set indicative of car passengers for car C by the ratio of the non-lobby car calls to all of the car calls. Then a pair of steps 76 will cause the fuzzy set indicative of car C interfloor up passengers to be transmitted to the group and set the up traffic timer to start a new one minute count. Then the step 63 will again set the stop done flag so that no further counting of car calls will occur until the flag is reset as a consequence of the test 68 indicating that the car is at the next stop, following which the test 72 indicates that the car is leaving the next stop. The process is thus repeated each time that a car leaves a stop in the up direction. Should, for some reason, there is no departure from a stop within one minute of the last departure, the test 64 will be affirmative, causing a count of the up car calls. Notice that test 64 will not cause the counting of up car calls except after the lobby calls have been established in the test 62 because test 46 will not reach the timer test until after the lobby calls have been done.

Figure 4:
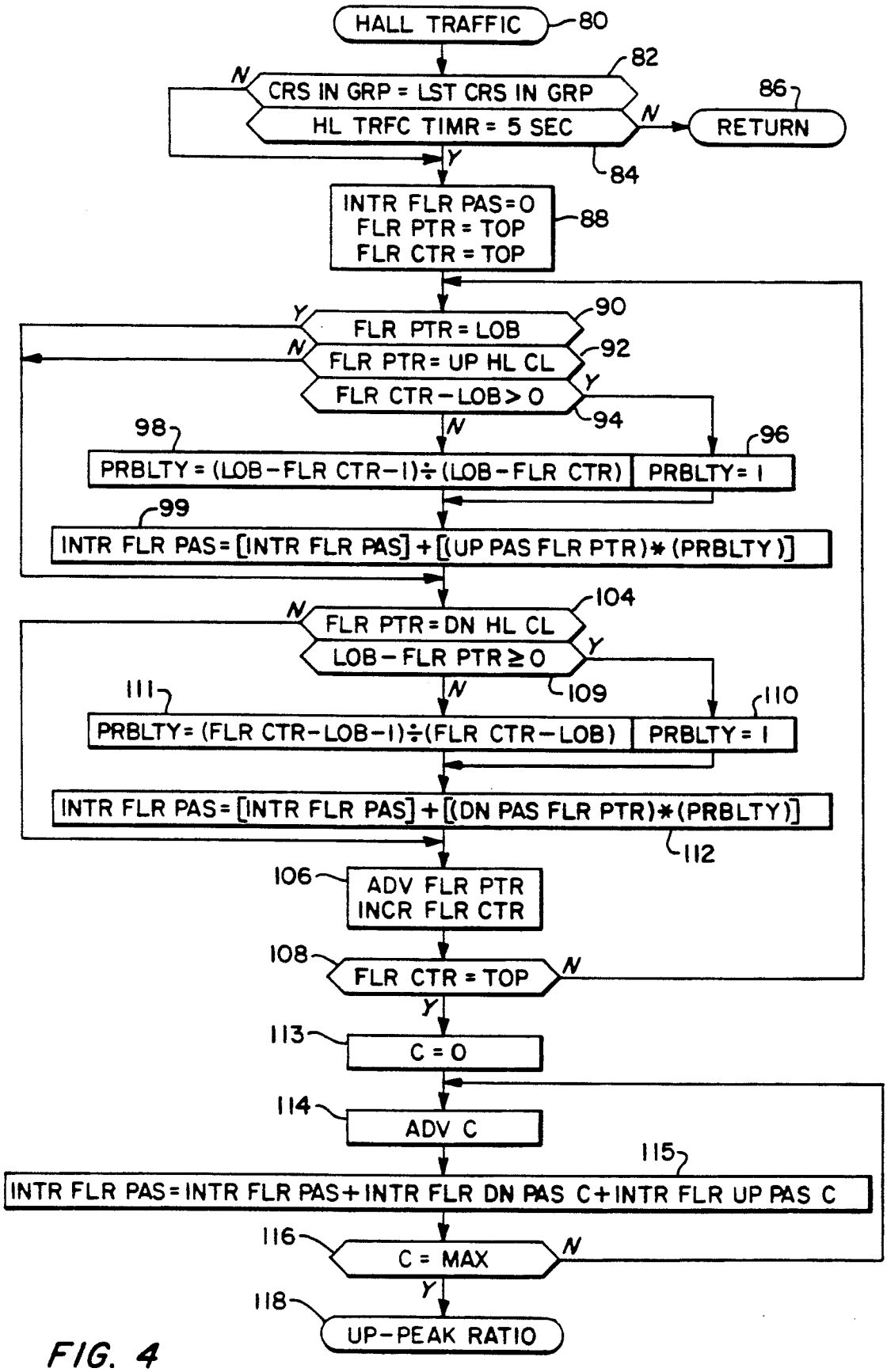

Referring now to FIG. 4, a hall traffic routine is reached through an entry point 80 and a first test 82 determines if the number of cars assigned to group operation (rather than being in simplex mode or off line) has changed since the last time that the hall traffic routine of FIG. 4 was performed. This is achieved by comparing, in the test 82, the current number of cars available in the group to the number of cars that were available in the group the last time the routine was run. If there are a different number of cars, then a negative result of test 82 will cause the routine of FIG. 4 to be performed; but if the cars are the same now as the last time that the hall traffic routine of FIG. 4 was run, then an affirmative result of test 82 will reach a test 84 to determine if five seconds have elapsed since the setting of the hall traffic timer. This routine is reached on the order of once each second, but the routine is performed only every five seconds, or if the number of cars in the group have changed. Therefore, a negative result of test 84 will cause reversion to other parts of the group control program through a return point 86. Whenever the number of cars assigned to the group has changed or five seconds have elapsed since the last time the hall traffic routine was run, a negative result of test 82 or an affirmative result of test 84 will reach a series of steps 88 wherein a large register, which will eventually hold a fuzzy set indicative of interfloor passengers is reset to all zero. Then, a floor pointer (which points successively to different floors for register addressing and logic) is set equal to the top floor and a floor counter (which is used for arithmetic operations involving floors) is also set to the top floor. Then, a test 90 determines if the floor pointer is set at the lobby floor (which will occur only when all of the floors from the top to the lobby have been handled in the routine). Initially, the result of test 90 must be negative so a test 92 determines if there is an up hall call registered for the floor indicated by the floor pointer. If there is, an affirmative result of test 92 reaches a test 94 to determine if the indicated floor is above the lobby. If it is, the floor counter minus the lobby floor will be a number greater than zero, and an affirmative result of the test 94 will therefore reach a step 96 where the probability of an up hall call being a non-lobby call is set equal to one. This is true, because any up call registered above the lobby will not be indicative of traffic going to the lobby so the probability of non-lobby traffic is absolute. On the other hand, if the floor pointer in fact is pointing to the lobby floor, the test 90 will not allow the test 94 to be reached. If the floor counter is indicating a floor below the lobby, then the subtraction of the lobby floor from the floor counter will yield a number which is less than zero and an affirmative result of the test 94 will reach a step 98 where the probability of an up hall call being made by a passenger who wants to reach a floor other than the lobby is developed as the ratio of the number of floors between the call and the lobby to the ratio of that number of floors plus the lobby. For instance, if the lobby is the sixth floor and an up call is registered from the third floor there will be a two-thirds chance of the traffic being interfloor traffic.

When the probability for an up hall call to be interfloor traffic (not to the lobby) is determined in either step 96 or 98, then the fuzzy set indicative of interfloor passengers (which has initially been set to zero) is updated in a step 99 by having added to it the probability times a fuzzy set indicative of the estimated passengers behind an up hall call at the floor indicated by the floor pointer (F). The fuzzy set indicative of the passengers estimated to be behind an up hall call at the floor indicated by the floor pointer is determined in accordance with the teachings of the aforementioned application entitled "Estimating Number of People Waiting for an Elevator Car Based on Crisp and Fuzzy Values". The resulting fuzzy set simply has its membership reduced by the probability if the probability is other than one; otherwise it is exactly the same as the fuzzy set of up passengers for the floor indicated by the floor pointer if the probability is one. After the step 99, the bottom floor is tested in a test 104 to see if there is a down hall call. Since this is impossible, a negative result of test 104 will reach a series of steps 106 where the floor pointer is advanced and the floor counter is incremented to point to the next floor above the bottom floor. Then a test 108 determines whether all of the floors have been evaluated; initially they will not, so that a negative result of test 108 will cause reversion to the test 90 to determine if the second floor has an up hall call, and the process repeats itself. If there is a down hall call for the floor indicated by the floor pointer, an affirmative result of the test 104 reaches a test 109 to determine if the floor pointer is pointing to a floor at or below the lobby, for which down hall calls are determined (in this embodiment) to be strictly interfloor traffic. If so, an affirmative result of test 109 will reach a step 110 which sets to one, the probability of the calls behind the down hall call on the floor indicated by the floor pointer of being interfloor traffic equal. But if the call is a down hall call above the lobby, then a step 111 provides a probability in a fashion similar to the step 99, which takes into account the number of floors between the down hall call and the lobby in determining the probability of the passengers behind the down hall call being interfloor passengers rather than relating to passengers leaving the building through the lobby (herein referred to as "down-peak passengers").

After the probability is determined in either of the steps 110, 111, the interfloor passengers fuzzy set is updated in a step 112 by having added thereto the fuzzy set indicative of the estimated number of passengers behind the down hall call for the floor indicated by the floor pointer, times the probability of those passengers being interfloor passengers. This is accomplished simply by using the probability to multiply the memberships of each of the terms in the fuzzy set. Once the fuzzy set of interfloor passengers has been updated to account for passengers on the current floor, the steps 106 will increase the floor counter and advance the floor pointer and the test 108 will determine whether all of the floors have been done or not. When all the floors have had the estimated passengers behind any down calls accommodated in the fuzzy set of interfloor passengers, an affirmative result of the test 108 will reach a step 113 wherein a car pointer (C) is reset to zero followed by a step 114 wherein the car pointer is advanced to one to identify the lowest numbered car in the group. Then, the interfloor passenger fuzzy set is updated in a step 115 by having added thereto the fuzzy sets of interfloor down passengers for car C (from FIG. 1) and the interfloor up passengers for car C (from FIG. 3). Then, a test 116 determines whether the estimated car call passengers for all of the cars have been added into the interfloor passenger fuzzy set or not. If not, the routine returns to steps 112 and 114 to add in the up and down passengers counts for the next car, until all cars are done. When all of the cars have been done, an affirmative result of the test 116 causes the program to advance to an up-peak ratio routine, illustrated in FIG. 5, through a transfer point 118.

Figure 2:
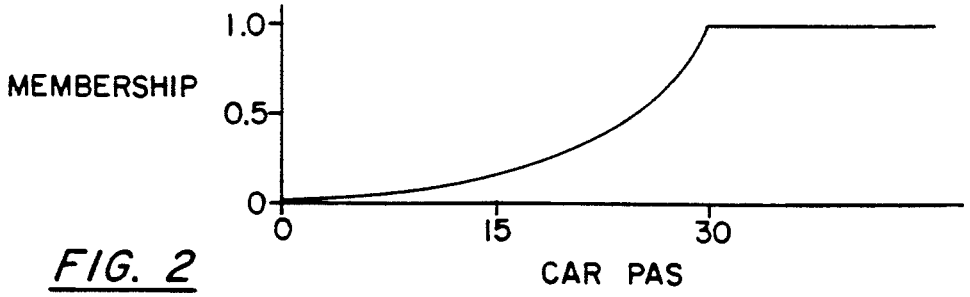
FIG. 2 is a graph illustrating a fuzzy set indicative of many interfloor passengers.
Figure 5:
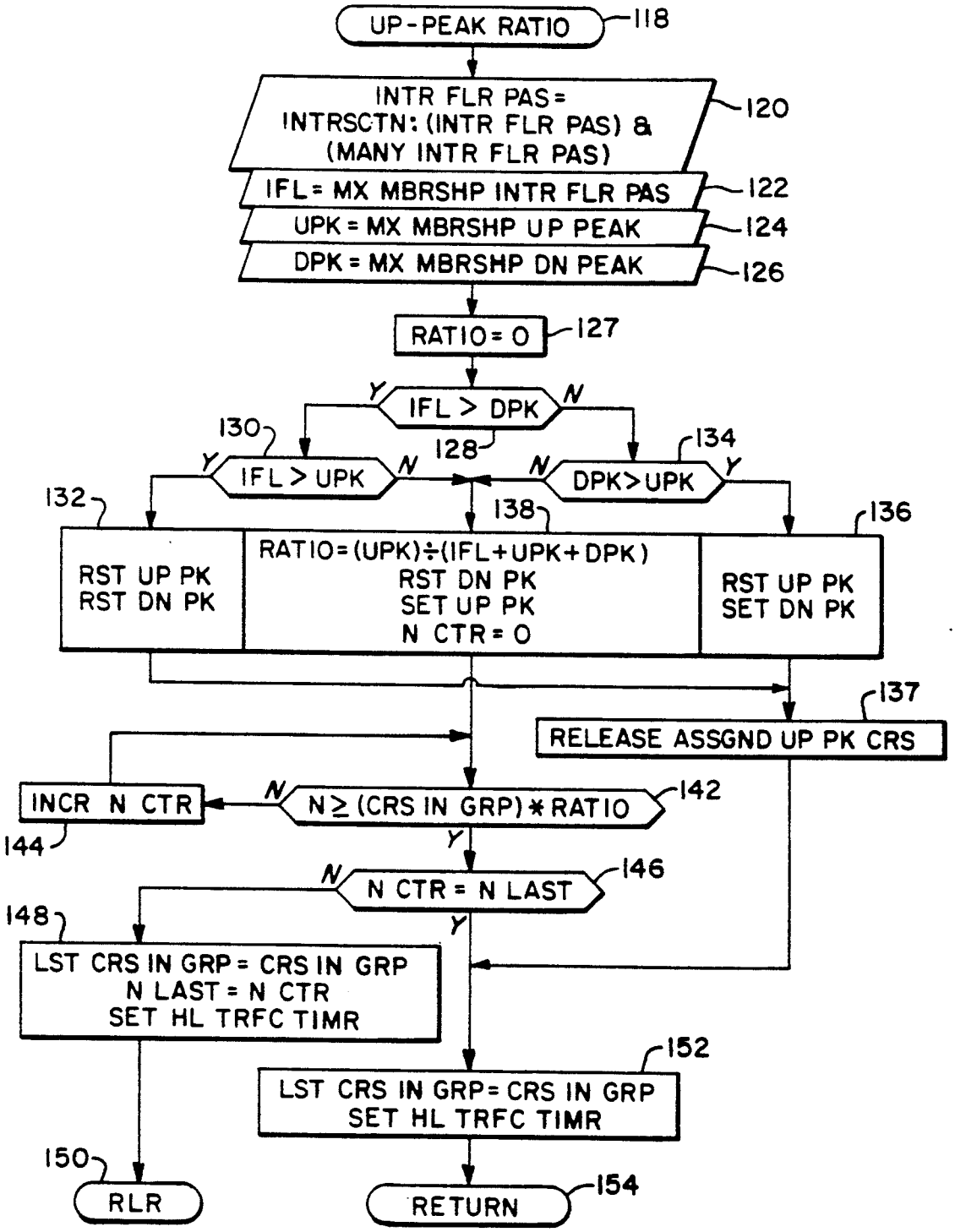

In FIG. 5, a routine 120 is called within which the interfloor passenger fuzzy set is intercepted with a fuzzy set indicative of many interfloor passengers. This fuzzy set will have a basis element for each number of passengers between one and a maximum number deemed to be possibly either in or waiting for elevator cars of this group for interfloor travel at any one time. This number depends on the size of the building and elevator system. As an example, a fuzzy set of what might be indicative (in accordance with elevatoring techniques and experience) of what many interfloor passengers may consist of is illustrated in FIG. 2. FIG. 2 is indicative in a smooth curve fashion of a fuzzy set which may have a basis element relating to each number of passengers from one to some large number (100 or 250), and each element having a membership indicative of the likelihood that such number of passengers is believed to be "many passengers" in terms of interfloor passengers for the purposes of determining whether the system should be operating in an up-peak mode, a down-peak mode or an off-peak mode. The interfloor passengers established in the fuzzy set resulting from intersecting the number of passengers fuzzy set with a fuzzy set of the type shown in FIG. 2, is indicative of the system requiring operation in an off peak mode. As illustrated in FIG. 2, the likelihoods and therefore the memberships in the fuzzy set range from zero to one and become one at some number of passengers (such as 30) and remain one for all numbers of passengers higher than that.

In FIG. 5 a subroutine 122 is called to determine a crisp number, IFL, which comprises the maximum membership of the interfloor passenger fuzzy set that resulted from the intersection taken by the routine 120. This is simply an iterative routine that compares the membership of the second term to the membership of the first term and saves the larger one, and so forth, until it has passed through all of the terms, and the largest one is the one that remains. In a similar fashion, a subroutine 124 is called to iteratively pass through the up-peak fuzzy set which is determined in accordance with FIGS. 6–10 of the aforementioned application entitled "Using Fuzzy Logic to Determine the Traffic Mode of an Elevator System" to provide a crisp value, UPK, to be indicative of the need for the system to be operating in the up-peak mode. And, a routine 126 is called to determine a crisp value DPK, as the maximum membership in the fuzzy set of down peak which is determined in accordance with the aforementioned application. This then provides three crisp values, IFL, indicative of an interfloor traffic (off-peak mode) requirement, UPK, indicative of an up-peak traffic mode requirement, and DPK, indicative of a down-peak traffic mode requirement. These are then compared, beginning with a first step 127 which initializes a ratio to zero. Then a test 128 determines if IFL is greater than DPK. If so, an affirmative result of test 128 reaches a test 130 where it is determined if IFL is also greater than UPK. If it is, then an affirmative result of step 130 will reach a pair of steps 132 where both up-peak and down-peak are reset so that the elevator system will operate in an off-peak mode. On the other hand, if DPK is equal to or greater than IFL, a negative result of test 128 will reach a test 134 where it is determined if DPK is greater than UPK. If it is, an affirmative result of test 134 will reach a pair of steps 136 where up-peak is reset and down-peak is set. The purpose of this is to ensure that the mode will be down-peak, regardless of what the mode previously was (down-peak, up-peak or off-peak). After either off-peak or down-peak is selected, to ensure that no cars are assigned to the up-peak mode, a step 137 will release all cars from the assignment to the up-peak mode. If up-peak (UPK) is greater than both down-peak (DPK) and interfloor traffic (IFL), as indicated by a negative result of either test 130 or test 134, steps 138 will reset down-peak and set up-peak so as to ensure that the up-peak mode will prevail in the group controller. This is the gist of one aspect of the invention: selecting the traffic mode based in part on the need for interfloor service.

The steps 138 will also set the ratio to be equal to the up-peak crisp value (UPK) divided by the summation of all of the crisp values. Thus, the ratio is the ratio to which up-peak bears to all of the modes together. And then, an N counter, equal to the number of cars which should be assigned to up-peak traffic, is reset to zero. Then a test 142 determines if the number N is greater than a number which results by multiplying the number of cars in the group times the ratio. This is the heart of another aspect of the invention, wherein the relative relationship between the degree to which the up-peak mode should be performed compared to the total of the degrees to which the up-peak, down-peak or off-peak modes should prevail, is utilized to establish the number of cars assigned to up-peak (in the same ratio as the need). Initially, N is zero (having been set to that in one of the steps 138), so a negative result of test 142 will reach a step 144 where the N counter is incremented and then test 142 is repeated until a number N has been achieved which is equal to or greater than the ratio times the number of cars in the group. If the product of the number of cars in the group and the ratio is truncated, so as just to be a whole number in each case, then one fewer cars will be assigned to up-peak for any values of the product which are between whole numbers, in comparison with the number of cars which would be assigned if the product is not truncated. The product utilized in step 142 could also be multiplied by some additional constant so as to cause the proper number of cars, in any given embodiment of the invention, to be assigned to up-peak. The constant could be less than one or more than one, simply to shade the value and thereby adjust what number of cars would be assigned to up-peak. In any event, once N has been determined, a test 146 determines whether the number of cars determined in test 142 within this pass through the routine of FIGS. 4 and 5 is the same as it was the last time. If it is, then there is no need to go through the process of picking which cars should be assigned to up-peak, since the proper number of cars have been assigned. But if the number of cars which should be assigned to up-peak is different in this cycle than it was in the next previous pass through this routine, then a negative result of test 146 will reach a step 148 which sets the value N last equal to the N counter for test in the next following cycle as just described. The step 148 will also set the value of the cars in the group in the last cycle (for subsequent testing) equal to the number of cars currently in the group for use in the test 82 (FIG. 4), and will set the hall traffic timer to begin a new five second interval for use in the test 84 (FIG. 4). And then, a relative lobby response routine of FIG. 6 is reached through a transfer point 150.

If there is no need to determine which of the cars should be assigned to up-peak, either because of the system being set into either down-peak or off-peak, or as a result of the same number of cars being required for up-peak as indicated by an affirmative result of test 146, then a pair of steps 152 will set the cars in group and hall traffic timer, as described above. And then the group controller program reverts to other functions through a return point 154.

Figure 6A:
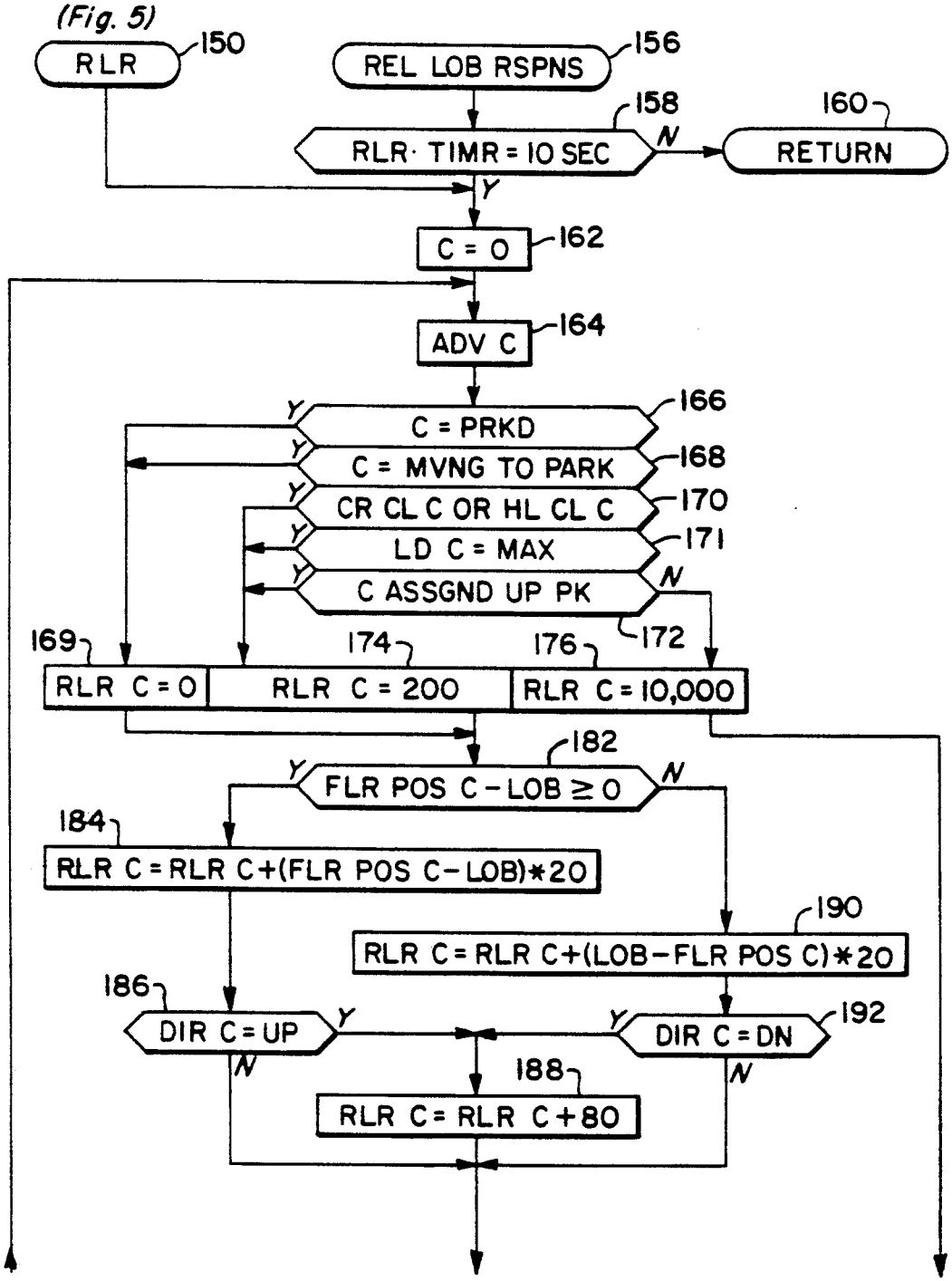
FIGS. 6A and B —relative lobby response.
Figure 6B:
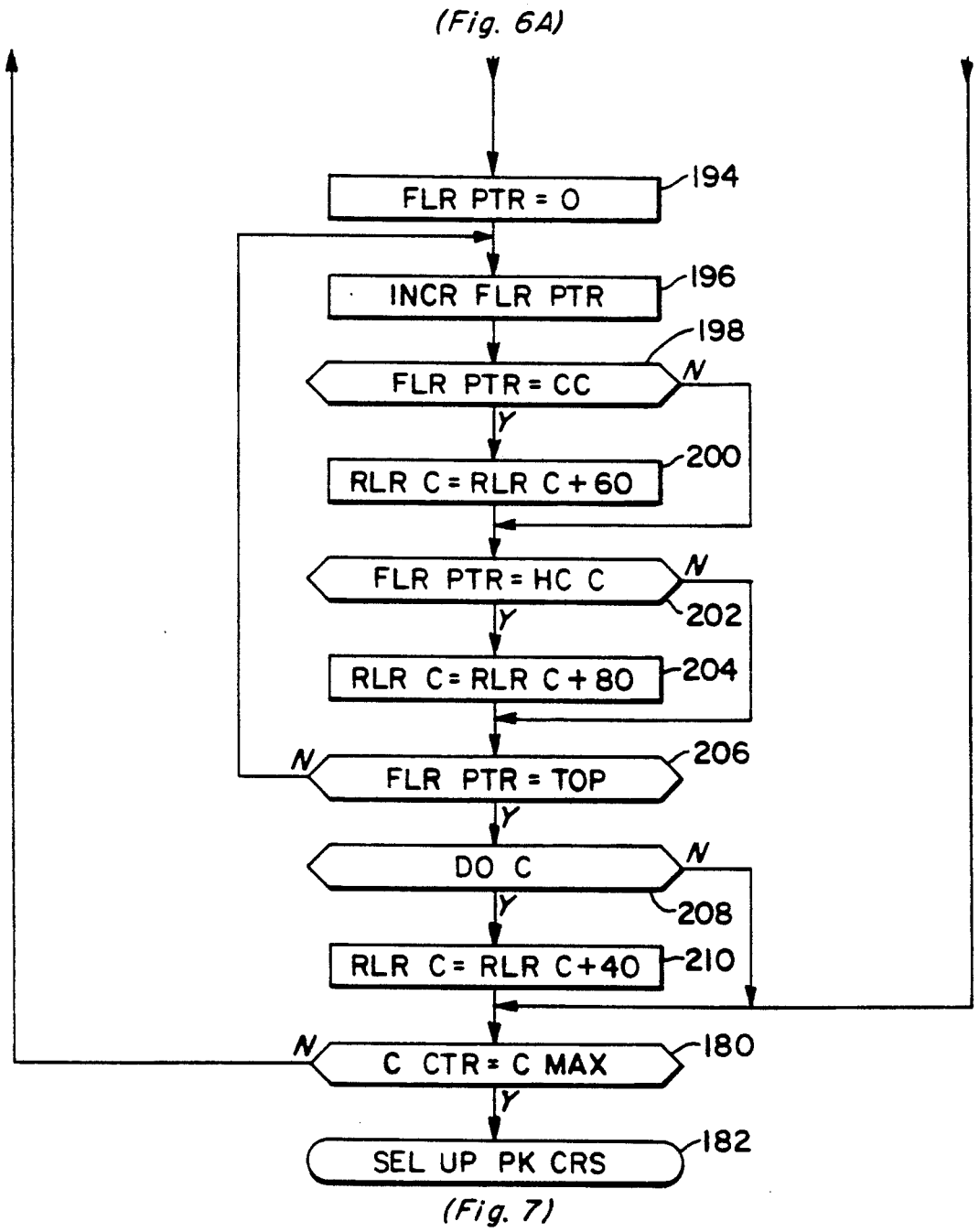

A relative lobby response routine illustrated in FIG. 6 is called any time that the number, N, of cars which should be servicing up-peak has changed, or each ten seconds. To determine that, the routine is called once every second or so through an entry point 156 and a test 158 determines if ten seconds have elapsed since setting an RLR timer. If not, other programming is reached through a return point 160. On the other hand, if the ten seconds have elapsed since setting the RLR timer, or if there is a change in the number of cars which should be assigned to up-peak, then either an affirmative result of the test 158 or a transfer through the point 150 will reach a series of steps 162 where a car pointer (C) is set equal to zero. Then, the C counter is advanced in a step 164 so as to point to the lowest numbered car in the group, and a test 166 determines if the car is parked. If not, a test 168 determines if the car is moving to become parked. An affirmative result of either test 166 or 168 is indicative of the car being idle, so the relative lobby response value is set equal to zero in a step 169, indicating that the car is readily available to serve up-peak. If the car is not idle, negative results of both tests 166 and 168 will reach a series of tests 170–172 where it is determined whether the car is available or not. If it has a car call or a hall call, or if it has a maximum load, or if it has already been assigned to up-peak traffic, then it is in service, and a step 174 will set the RLR register to a value indicating that the cars are busy, which may be on the order of 200. But if it is not idle and it is not in service, then it is not available so a negative result of all of the tests 166, 168, 170–172 will reach a step 176 where the RLR register is set to some maximum value, such as 10,000. If the step 176 sets the RLR value to its maximum, then the process is complete with respect to that particular car, so the routine advances to a test 180 to see if all cars have been tested. Initially, they will not have been, so a negative result of test 180 will cause the routine to revert to the step 164 where the C pointer is advanced to point to the next car of the group. Then, the tests 166 and 168 are repeated to see if the car is idle, and the tests 170–172 are repeated to see if the car is busy or unavailable.

Assuming that one of the tests is affirmative, after one of the steps 169, 174 a test 182 is reached which determines whether the car is at or above the lobby or below the lobby. If it is at the lobby or above, an affirmative result of test 182 will reach a step 184 where the RLR register is incremented by an amount indicative of the distance that the car is away from the lobby, which is determined by 20 times the difference between the car's current position and the lobby floor. And then it is determined, in a test 186, whether the car is traveling away from the lobby; if it is, a step 188 will add to the RLR register a number such as 80 which is indicative of the amount of time that it will take the car to reverse direction. On the other hand, if the car is below the lobby, a negative result of test 182 will reach a step 186 where the distance to the lobby is accommodated by multiplying 20 times the number of floors that the car is below the lobby and then a test 192 determines if the car is traveling away from the lobby. If it is, then the RLR register is incremented to reflect the need to change direction, such as by 80.

Then a series of steps and tests add factors indicative of delays that can be caused by stopping for car calls and hall calls. This is commenced by setting the floor pointer to zero in a step 194. Then a step 196 increments the floor pointer so as to point to the first floor and a test 198 determines if there is a car call registered for that floor. If so, a step 200 will add 60 to the RLR register to reflect the amount of time it takes to service a car call. If not, the step 200 is bypassed. Then a step 202 determines if there is a hall call registered for the floor currently indicated by the floor pointer. In fact, both up calls and down calls may (in reality) be separately checked. If so, a step 204 adds 80 to the RLR register; but if not, then the step 204 is bypassed. A test 206 determines if all of the floors have been examined to determine if this car has any car calls registered in it or hall calls assigned to it; initially, that will not be the case and a negative result of the test 206 will cause the routine to revert to step 196 to increment the floor pointer and provide the car call and hall call tests for the next floor in turn. When the calls for all floors have been determined, an affirmative result of the test 206 reaches a test 208 where it is determined if the door of car C is open; if it is, a step 210 will add a count of about 40 to the RLR register to reflect the amount of time it will take for the door to close before it can be assigned to up-peak traffic; if the door is not open, the step 210 is bypassed. Then, the test 180 determines if all of the cars have had their RLR values established. Initially, they will not, so a negative result of test 180 will reach the step 164 where the car counter is incremented so that the determinations can be repeated for the next car in turn. When all of the cars have had their RLR values established, an affirmative result of test 180 will cause the program to advance to a select up-peak cars routine through a transfer point 182, as illustrated in FIG. 7.

Figure 7:
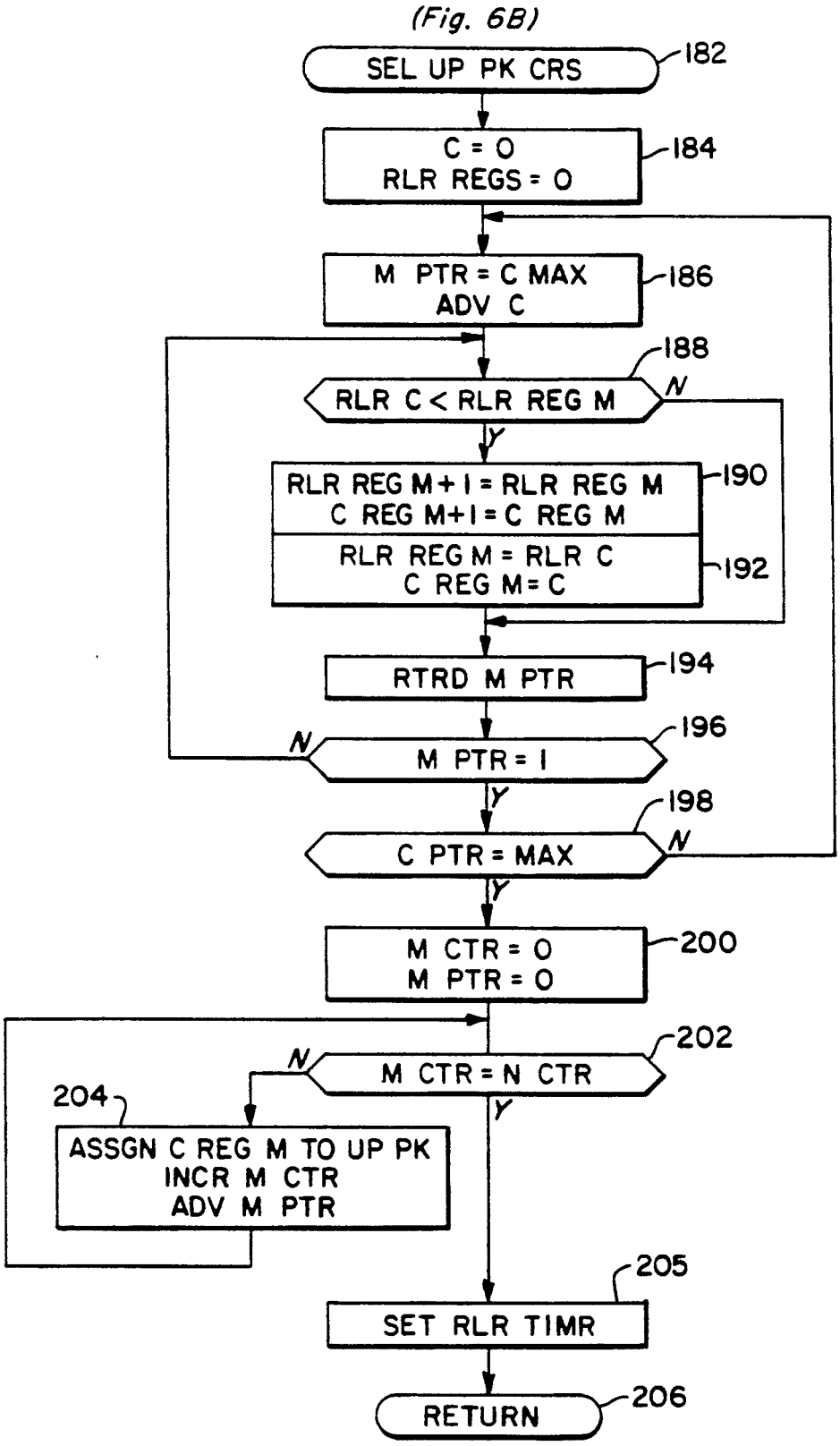

In FIG. 7, a pair of sets of steps 184, 186 will set the C pointer to zero, step an M pointer (which tracks the value of N, the number of up-peak cars needed, hereinbefore) to equal the highest numbered car in the system, and number (M) of RLR registers (which are described immediately hereinafter) are set to some maximum value such as 10,000, and the car pointer is advanced in a step 186 so as to point to the first car of the group. The process in FIG. 7 thereafter determines which car has the lowest RLR value. Then the RLR value of the first car is compared with that for register M (which initially is set to max) to see if it is less than that or not. Unless it has also been set to max (at step 176, FIG. 6) the value will be less than max so an affirmative result of the test 188 will reach a pair of steps 190 where the RLR value in an RLR register and a C register numbered M are transferred to the next higher numbered RLR and C registers. (When the M pointer is at max, as in the first pass, the contents of the Mth registers are just dumped.) And then in steps 192, the RLR and C values in the registers numbered M are set equal to those for car C. Thus, the values for car C have now been entered into the highest numbered of the RLR and C registers. Then, the M pointer is retarded (reduced by one) in a step 194 and it is tested in a test 196 to see if the M pointer has been retarded to a value of one or not. Initially, it will not have been, so a negative result of test 196 will reach the test 188 again to see if the RLR value for this car is lower than that of the next register in turn. In the first pass through, any RLR number less than maximum will ripple down through and be established in all M of the RLR registers, and the car number (car C) will be registered in all M of the C registers. When all M of the RLR registers have been tested, then an affirmative result of the test 196 will reach a test 198 to determine if t he RLR values of all the cars have been compared, or not. Initially, they will not have been, so a negative result of test 198 will reach the steps 186 to restore the M pointer to the maximum value and to advance the car pointer to point to the next car, in turn, so that the process can be repeated.

Assuming that the second car has a lower RLR value than the first car, the values in each RLR and C register are bumped into the next higher numbered RLR and C register, and the values of RLR and C for the current car take their place; this will result in the second car number being in C register 1 and its RLR value in RLR register I, the number of car number 1 is in C register 2, and its RLR value is in RLR register 2, and maximum RLR values are in the remaining higher numbered registers (having been successively bumped there in the two iterations so far). Then, the test 198 again determines if the RLR values of all cars have been compared;

when that has happened, the car number of the car having the lowest RLR value will be in C register 1 and its RLR value will be in RLR register 1; the car having a second lowest RLR value will have its number in C register 2 and its RLR value will be in RLR register 2. The values in the RLR registers are only used in the process to determine which one has the lowest number, and the desired objective result is to have the car numbers established in the registers RLR value order so that the car numbers are in the order of their RLR value in the C registers 1, 2, 3, 4, etc. When this has been achieved, an affirmative result of the test 198 will reach a series of steps 200 in which the M pointer is restored to zero and an M counter is set to zero. Then, the first N cars are assigned to up-peak (N being the number of cars determined by the ratio at test 142 in FIG. 5). A test 202 determines if N cars have been assigned to up-peak or not. Initially, that will not be the case so a negative result of test 202 will reach a series of steps 204 in which the car identified in C register M is assigned to up-peak service, and the M counter is incremented and the M pointer is advanced so as to assign another car to up-peak, if necessary, as determined by the test 202. When, however, as many cars as have been determined to be required for up-peak service have in fact been assigned to up-peak service in the steps 204, the RLR timer is set in a step 205 to establish a new 10 second period for the test 158 of FIG. 6, and other parts of the group controller program are reached through a return point 206.

The invention has been described in an embodiment which utilizes fuzzy sets to express passengers in the car and estimates of passengers behind up calls and down calls in a manner provided as set forth in the aforementioned U.S. patent applications. The invention can also be practiced utilizing crisp values which are described in the aforementioned U.S. patent applications. For instance, the best estimate of the number of passengers in a car as it leaves a stop can be determined as in the aforementioned patent application entitled "Using Fuzzy Logic to Determine the Number of Passengers in an Elevator Car". Similarly, instead of combining fuzzy sets with fuzzy sets to obtain new fuzzy sets from which single memberships are extracted, the determination of numbers of passengers behind calls and onset of up-peak or down-peak can also be achieved using crisp values. In such a case, the advantages that accompany use of fuzzy logic will be lost; but the advantage of the present invention does not depend on also having the advantages of using fuzzy logic. Thus, the advantages of the present invention, that the need for interfloor traffic is also looked at before declaring a peak mode and that up-peak no longer need an all-or-nothing traffic mode, but rather can be of variable intensity based upon finding the ratio of need and assigning cars to up-peak in a proportionate fashion, may be had with fuzzy or crisp calculations.

The routines of FIGS. 1 and 3–7 are exemplary only: that is, these routines teach the precepts of the present invention but they are not, certainly, the only way in which the invention may be practiced, nor do they necessarily represent the best way to practice the invention. Much depends on the nature and quality of signals which are otherwise available in an elevator. For instance, in FIG. 3, test 48 determines when the elevator is decelerating for a stop. If a signal indicative of deceleration is not readily available in an elevator, then other types of signals could be used. As an example, a combination of signals indicating that the committable floor is the next floor and that the last floor is the lobby floor is sufficient, since nearly all car calls are registered even before the car leaves the lobby and certainly before it approaches the next floor above the lobby.

The assignment of a car to up-peak can be accomplished at any moment in time. It is immaterial at what moment in time the assignment occurs. The reason for this is that the assignment to up-peak service, in the general case, simply means that a car is taken out of the set of cars available for answering hall calls, and the car is forced to the lobby whenever it would otherwise become idle. Therefore, assuming a car is proceeding upwardly in the building, has a few car calls registered and a couple of hall calls assigned to it, it nonetheless can immediately become assigned to up-peak, proceed to do all these chores and then return to the lobby forthwith. In a system in which hall call assignments are repeated over and over and over until an assigned car is at the committable floor for the stop, the assignment of a car to up-peak could ignore hall calls altogether, causing elevators that can return most quickly to the lobby (as if they do not have hall calls assigned to them) be assigned to up-peak, and the hall calls would be reassigned to other cars almost instantly. On the other hand, as in the present embodiment, if hall calls are taken into account, then the elevators are allowed to answer the assigned hall calls before returning to the lobby. In a preferred embodiment, any car assigned to up-peak service could be evaluated for the assignment of hall calls thereto, but would have a penalty related to about a fifty second delay assigned to it so as to normally not have hall calls assigned to it so long as the system is operating smoothly, but to help alleviate undue interfloor traffic delays if necessary. These and other details of operation are well within the concepts of the present invention. The exemplary numbers for timers, for RLR factors, and otherwise herein are not essential to the present invention, but are merely exemplary to provide real understanding of how the invention may be implemented. Certainly, the various numbers and times are easily adjusted to better suit any utilization of the present invention.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

I claim:

1. A method of dispatching elevator cars in a building serviced by a plurality of elevator cars operating, inter alia, either in an up-peak mode, a down-peak mode or an off-peak mode within a group, comprising:

providing an interfloor signal indicative of a number representing the relative present need to provide interfloor service to passengers in said elevator system;

providing an up-peak signal indicative of a number representing the relative present need to provide up-peak service to passengers in said elevator system;

providing a down-peak signal indicative of a number representing the relative present need to provide down-peak service to passengers in said elevator system;

in the event that both said down-peak signal and said interfloor signal are less than or equal to said up-peak signal, dispatching elevator cars in said elevator system in accordance with a method employing an up-peak mode which utilizes a number of the cars available in the elevator group determined as a function of the relationship between said up-peak signal, said interfloor signal, and said down-peak signal.

2. A method according to claim 1 employing an up-peak mode which utilizes a number of cars related to the number of cars available in the elevator group determined as a function of the ratio of said up-peak signal to the summation of said interfloor signal, said up-peak signal and said down-peak signal.

3. A method of dispatching elevator cars in a building serviced by a plurality of elevator cars operating, inter alia, either in an up-peak mode, a down-peak mode or an off-peak mode within a group, comprising:

providing an interfloor signal indicative of a number representing the relative present need to provide interfloor service to passengers in said elevator system;

providing an up-peak signal indicative of a number representing the relative present need to provide up-peak service to passengers in said elevator system;

providing a down-peak signal indicative of a number representing the relative present need to provide down-peak service to passengers in said elevator system;

dispatching elevator cars in accordance with a method which alternatively either employs an up-peak mode of operation for rapidly transferring passengers from a lobby floor to upper floors of the building in the event that said up-peak signal indicates a number greater than the number indicated by either said down-peak signal or said interfloor signal, or employs a down-peak mode of operation in which passengers in the upper floors of the building are rapidly returned to the lobby floor of the building in the event that said down-peak signal indicates a number greater than the number indicated by either said up-peak signal or said interfloor signal, or employs an off-peak mode of operation, which is different from said up-peak mode of operation and said down-peak mode of operation, in the event that said interfloor signal indicates a number greater than either said up-peak signal or said down-peak signal.

4. A method according to claim 3 wherein said dispatching step employs an up-peak mode which utilizes a number of the cars available in the elevator group determined as a function of the relationship between said up-peak signal, said interfloor signal, and said down-peak signal.

* * * * *